United States Patent [19]

Geiger

[11] Patent Number: 4,473,163

[45] Date of Patent: Sep. 25, 1984

[54] SCREW CAP WITH INNER AND OUTER COVERS

[75] Inventor: Eduard Geiger, Küsnacht, Switzerland

[73] Assignee: Ernst & Co., Inh. Geiger & Neuenschwander, Switzerland

[21] Appl. No.: 442,658

[22] Filed: Nov. 18, 1982

[30] Foreign Application Priority Data

Nov. 19, 1981 [CH] Switzerland ..... 7434/81

[51] Int. Cl.[3] ..... B65D 41/04

[52] U.S. Cl. ..... 215/250; 215/276; 215/277; 215/350

[58] Field of Search ..... 215/276, 277, 350, 250

[56] References Cited

U.S. PATENT DOCUMENTS

| | | | |
|---|---|---|---|
| 3,006,493 | 10/1961 | Acton | 215/350 X |
| 3,445,023 | 5/1969 | Giessler et al. | 215/276 X |
| 4,093,094 | 6/1978 | Smalley et al. | 215/276 |
| 4,109,815 | 8/1978 | Collins | 215/277 X |

FOREIGN PATENT DOCUMENTS

| | | | |
|---|---|---|---|
| 498341 | 9/1954 | Italy | 215/276 |
| 1000164 | 8/1965 | United Kingdom . | |

*Primary Examiner*—Donald F. Norton

*Attorney, Agent, or Firm*—Roylance, Abrams, Berdo & Goodman

[57] ABSTRACT

The screwcap comprises an inner cap and an outer cap. The outer cap is threaded on a container neck. The screwing action presses the inner cap and its sealing layer in an axial direction against the opening edge. An outer edge portion of the inner cap projects radially over the neck and is at a first distance over a projection on the inside of the outer cap collar. The projection only contacts the outer edge portion of the inner cap when the outer cap is unthreaded. Continued unthreading movement initially only raises the inner cap from the opening edge at a locally defined peripheral point through engagement of the projection on the lower edge of the inner cap outer edge portion, prior to complete raising of the inner cap, to eliminate a vacuum in the container. This reduces the force necessary for opening the screwcap.

22 Claims, 9 Drawing Figures

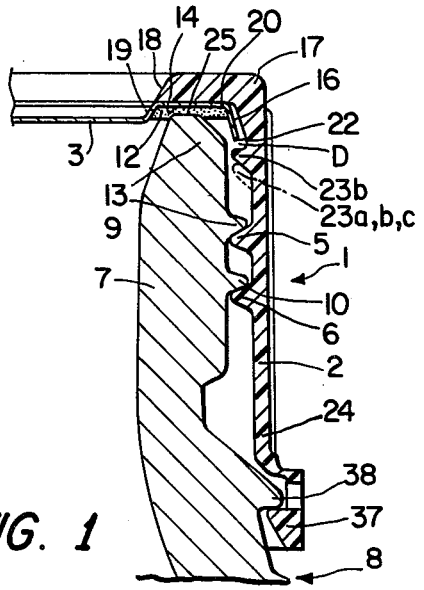
FIG. 1
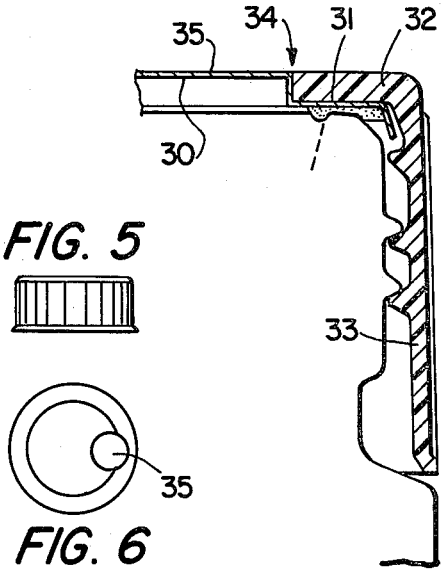
FIG. 4
FIG. 5
FIG. 6
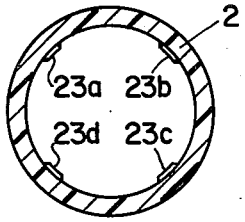
FIG. 2
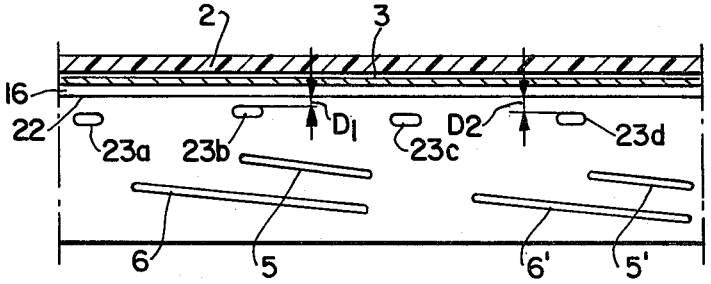
FIG. 3
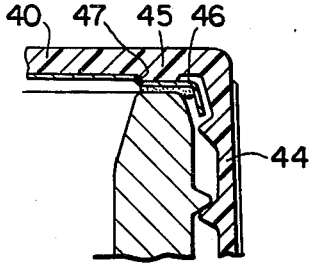
FIG. 7
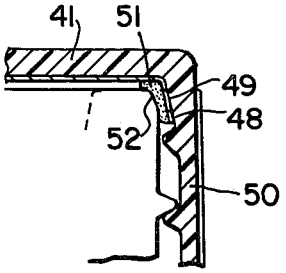
FIG. 8
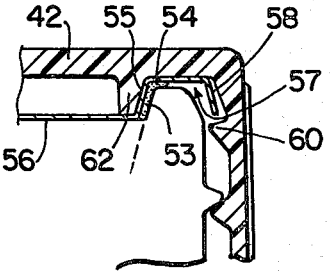
FIG. 9

SCREW CAP WITH INNER AND OUTER COVERS

FIELD OF THE INVENTION

The present invention relates to a screwcap for a container, having a metallic inner cap and a plastic outer cap. More particularly, the present invention relates to a screwcap with an inner cap forming a seal with the container and an outer cap retaining the inner cap on the container, wherein the outer cap has a projection for lifting the inner cap from the container opening at locally defined peripheral point when the outer cap is unthreaded from the container.

BACKGROUND OF THE INVENTION

British Pat. No. 1,000,164 discloses a screwcap with an inner cap and an outer cap made from easily deformable sheet metal so that the outer cap threads can only be produced during closing of the container by rolling on the container threads. A groove or peripheral rib, for maintaining the inner cap in the outer cap before closing the container, is also produced by roll shaping on the collar part of the outer cap. A guarantee strip is provided at the open end of the outer cap collar, and is connected thereto by means of a peripheral, predetermined breaking point. The guarantee strip embraces an annular rib provided on the container and is also formed by cold working, i.e. by rolling the corresponding part of the outer cap onto the outer periphery of the container. The cap is only raised from the container after destroying the guarantee strip at the predetermined breaking point.

When unscrewing the cap from the container opening, it is not simultaneously necessary to apply a torque for destroying this peripheral predetermined breaking point between the guarantee strip and the remainder of the outer cap, and a torque for raising the inner cap from the container opening. The inner cap is held with sufficient play in the groove or by the peripheral rib in the outer cap such that it is only raised from the container opening, counter to the force of the vacuum in the container and the adhesion of its sealing material to the container opening, after the predetermined breaking point has been destroyed and/or the guarantee strip has already been detached from the outer cap.

Such conventional screwcap is relatively expensive due to its material and the production process. Its partial production by rolling on the periphery of the normally glass container can damage the container edge. In addition, the cap material has a sharp edge and can therefore cause injury. It was considered necessary to use sheet metal for producing the screwcap because, on applying the sealing material, e.g., flexible PVC, to the inside of the cap, it is necessary to heat to approximately 200° C., i.e. to a temperature which would damage normal plastic material.

Maintaining the inner cap in the outer cap by a peripheral rib or in a peripheral groove is disadvantageous. On unscrewing the cap, the rib comes into contact with the entire edge of the inner cap so that the inner cap is simultaneously raised over its entire periphery. Due to the vacuum normally present in the container and the adhesion of the sealing layer of the inner cap to the face of the container opening, the opening forces can be so great, particularly in large diameter containers for baby food and the like, that the easily deformable outer cap is unthreaded over the inner cap without raising it. The inward sloping of the edge of the inner cap in the embodiments disclosed in British Pat. No. 1,000,164 for maintaining the sealing material in place increases this problem. When this occurs, the inner cap must be detached with a tool, e.g. a knife, which must be forced between the opening edge and the inner cap. The aforementioned disadvantages of this conventional cap have prevented it from being used commercially.

SUMMARY OF THE INVENTION

An object of the present invention is to provide a screwcap which obviates the aforementioned disadvantages.

Another object of the present invention is to provide a screwcap which can be made less expensively and which permits the container to be reliably and simply opened, while exerting less force.

The foregoing objects are obtained by a screwcap for a container opening, comprising an inner cap and a plastic outer cap. The inner cap is formed of sheet metal, forms a seal with the opening edge of a container and has an outer edge portion. The outer cap has a collar, a radially inwardly directed first projection on an inner surface of the collar for threadedly engaging a corresponding sloping projection on the container, and a plurality of radially inwardly directed second projections peripherally distributed on the collar engaging the inner cap edge portion in an opening position. The second projections are separate from the first projection and are spaced from a lower edge of the inner cap edge portion in a closed position at varying distances less than the overall pitch height of the threaded connection between the first projection and the container. After unthreading of the outer cap from the container has started, one second projection located to the closest to the edge portion initiates lifting of the inner cap and its seal at a locally defined peripheral point on the inner cap.

As a result of the present invention, on releasing the cap, it is initially only necessary for one or two short projections to force a peripherally, closely bounded area of the inner cap upwardly. Thus, such area can be raised or deformed to a sufficient extent that the vacuum in the container is destroyed. The use of plastic for the outer cap simplifies forming such short projections on its inner wall with a stud, spike or hook-shaped configuration. The use of plastic for the outer cap also eliminates some of the aforementioned disadvantages of a screwcap made entirely from sheet metal. Since the inner cap is still made from sheet metal, the inner cap can be provided in conventional manner and at an elevated temperature with a sealing material.

The use of individual, short projections for maintaining the inner cap in the outer cap and for raising the inner cap also advantageously permits the inner cap to be more easily connected to the outer cap at the time of manufacture, i.e. prior to connection to the container.

Preferably, two second projections are diametrically opposed and are spaced from the inner cap edge portion by a distance greater than the closest second projection. The closest second projection can be located between the diametrically opposed second projection.

Since the outer edge of the inner cap slopes outwardly, on raising the inner cap by the short projections, the outer edge is supported in an optimum manner thereon. Also, the projections are prevented from sliding radially outwardly over the outer edge without raising the inner cap.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 1 is a partial side elevational view in section of a screwcap and container neck according to a first embodiment of the invention;

FIG. 2 is a reduced to plan view in section of the screwcap of FIG. 1;

FIG. 3 is a partial side elevational view in section of the screwcap of FIG. 1;

FIG. 4 is a partial side elevational view in section of a screwcap and container neck according to a second embodiment of the present invention.

FIG. 5 is a reduced, side elevational view of the screwcap of FIG. 4;

FIG. 6 is a top plan view of the screwcap of FIG. 5;

FIG. 7 is a partial side elevational view in section of a screwcap and container neck according to a third embodiment of the present invention;

FIG. 8 is a partial side elevational view in section of a screwcap and container neck according to a fourth embodiment of the present invention; and FIG. 9 is a partial side elevational view in section of a screwcap and container neck according to a fifth embodiment of the present invention.

DETAILED DESCRIPTION OF THE PREFERRED Embodiments of the Invention

FIG. 1 shows a screwcap 1 with a plastic, annular outer cap 2 and a punched and deep-drawn sheet metal inner cap 3. By the engagement of two threads or first projections 5, 6 with threads 9, 10 shaped externally on the opening neck 7 of a container 8, outer cap 2 is axially secured over inner cap 3, and soft-elastic sealing layer 12 sealingly engages the face of opening edge 13 accompanied by elastic deformation. The sealing layer is located in an annular groove 14 on the bottom of inner cap 3. Groove 14 is outwardly bounded by a downwardly sloping outer edge portion 16 of the inner cap. Outer cap 2 covers inner cap 3 with a radially directed wall part 17, corresponding to the width of groove 14. The radial inner edge 18 of outer cap 2 is flush with the radial inner edge 19 of groove 14 of inner cap 3.

The contact surface 20, by which outer cap 2 presses the inner cap into sealing contact with opening neck 7, is in the form of a sliding surface. Outer cap 2 can be turned by exerting relatively little force, without peripherally displacing the inner cap 3. The contact between the varnished top of inner cap 3 and the plastic material of the outer cap provides adequately low frictional resistance so that the treading movement of the outer cap is only opposed by relatively limited frictional resistance. Further frictional contacts only exist between threads 5, 9, and 6, 10.

At a distance $D_1$ from the lower edge 22 of edge portion 16 of inner cap 3, a cross-sectionally triangular second projection **23*b* is formed on the inside of collar 24 of the outer cap. The projection is relatively short in the peripheral direction of the cap. Other identically shaped second projections 23*a*, 23*c*, 23*d* are peripherally distributed at a somewhat greater distance $D_2$ from the lower edge 22** of the inner cap.

Pressing of the inner cap into the outer cap is facilitated by projections **23*a* to 23*d* on assembling the screwcap. On unscrewing the cap, projection 23*b* is first to raise inner cap 3 in the axial direction from the container opening. Distance $D_1$ delays this lifting movement until after the firmly screwed-down outer cap 2 has been released. On further unscrewing outer cap 2, projection 23*b* engages beneath edge portion 16 of inner cap 3 in sliding contact with lower edge 22 to raise locally inner cap 3 from sealing surface 25 on the face of opening edge 13. The further projections 23*a*, *c* and *d* located at the distance $D_2$ subsequently engage edge portion 16** to completely raise the inner cap.

As a result of projection **23*b*, the raising force only acts in a locally defined zone on the periphery of the inner cap 3. The inner cap is only initially raised in this zone, and the vacuum in the container is removed before the complete inner cap is raised. As a function of the size of the vacuum, the force to be locally applied by projection 23*b* can be relatively high. Advantageously, projection 23*b* is arranged above the central area of a thread engagement zone provided by threads 5, 6 so that this force is uniformly transferred to the engagement zone of threads 5, 6. This will avoid one-sided loading of the outer cap 2 preventing the threads or ribs 5, 6 of the thread engagement zone from sliding down from the mating threads 9, 10 of container neck 7. FIG. 3 illustrates this arrangement of projection 23*b***.

FIG. 2 shows the arrangement of projections **23*a*, 23*b*, 23*c* and 23*d* at the same angular distances or spacings on the inner wall of outer cap 2. This arrangement facilitates the insertion of inner cap 3** prior to the use of the screwcap, i.e. before the screwcap is screwed onto the opening of a container.

In place of the number of projections shown in the embodiment, it is possible to use more or less second projections. It is recommended to use no fewer than three peripherally arranged projections so that inner cap 3 is reliably held in outer cap 2. When using only three projections, they are preferably arranged to angular distances of 120° from one another.

FIGS. 4 to 9 show various shapes of the inner and outer caps in the vicinity of the cap part spanning the container opening and the opening edge. In FIG. 4, inner cap 30 has an annular shoulder 31, which receives the radially directed wall part 32 of outer cap 33 such that the top of the inner cap terminates in flush manner with this wall part. This construction advantageously forms a gap 34 between inner cap 30 and outer cap 33. The gap can be covered in a simple manner by an adhesive foil 35, which serves as a guarantee closure. Opening of the screwcap is only possible after shearing foil 35 due to relative turning movement between the inner and outer caps. FIGS. 5 and 6 show the closure of FIG. 4 on a smaller scale. In FIG. 6, foil 35 is in the form a washer or disk. In lieu of a locally applied foil 35, the entire top of the screwcap can be covered by a decorative foil serving as a guarantee closure.

In the embodiment of FIG. 1, the guarantee closure is formed by a conventional overlap bead 37. Bead 37 embraces a peripheral bead 38 in the lower area of the opening neck 7. Opening of the screwcap is only made possible by tearing off overlap bead 37.

In the embodiments of FIGS. 7 to 9, unlike the embodiments of FIG. 1 and 4, the upper wall part 40, 41 or 42 of the outer cap is closed and is profiled on its underside so that the sealing layer is pressed on a small annular area.

In the embodiment of FIG. 7, an annular projection or step 45 is provided at a distance from the collar part 44 and engages a stepped edge area 46 of the inner cap with a planar surface to surface contact. Step 47 is adapted to the shape of the radial inner edge of projection 45 so that the projection centers the inner cap relative to the outer cap.

According to the embodiment of FIG. 8, a downwardly directed edge 48 of the inner cap engages a sloping wall part 49 in the transition area between collar part 50 and upper wall part 41 of the outer cap. This engagement presses sealing layer 51 radially inwardly on the outer edge bead 52 of the container opening.

FIG. 9 shows an embodiment in which the sealing pressure acts radially outwardly on the inner bead 53 of the opening edge. The sealing layer 54 is arranged on a radially inner side wall 55 of an annular groove 57 shaped by deep-drawing inner cap 56. The radially outer side wall 58 of this groove forms the outer edge portion of the inner cap 56 for engaging the cross-sectionally lug-like second projection 60. The two side walls 55, 58 of groove 57 are inclined so that the groove has a downwardly widening trapezoidal cross-sectional configuration. The sloping outer face of radially outer side wall 58 can slide upwardly on the lower inclined surface of projection 60 when inserting inner cap 56 into the outer cap. Radially outer side wall 58 subsequently engages behind projection 60. The lateral face of a projection 62 engages the radially inner, sloping wall 55. Projection 62 is formed on the underside of the upper wall part 42 of the outer cap. As a result of this engagement, the sealing force applied by the outer cap is transferred to the small, annular sealing area.

The screwcap according to the present invention can have its outer cap connected to the opening neck of the container in any manner, provided that the opening of the cap is accomplished by a screwing movement. It is generally possible for one-sided screw contact to take place on sloping control paths, i.e., complete threads are not required as shown in FIG. 3. The closing movement of the outer cap can take place by simply axially pressing on the screw cap so that the inner first projections of the collar snap over the outer projections of the opening neck.

While various embodiments have been chosen to illustrate the invention, it will be understood by those skilled in the art that various changes and modifications can be made therein without departing from the scope of the invention as defined in the appended claims.

What is claimed is:

1. A screwcap for a container having an opening and a sloping projection for forming a threaded connection, the screwcap comprising:

an inner cap formed of sheet metal, having seal means for forming a seal with an opening edge of a container and having an outer edge portion; and a plastic outer cap having a collar, at least one radially inwardly directed first projection means, on an inner surface of said collar, for threadedly engaging a corresponding sloping projection on the container to form a threaded connection with an overall pitch height, and a plurality of radially inwardly extending second projections peripherally distributed on said collar engaging said edge portion of said inner cap in an opening position, said second projections being separate form said first projection means and being spaced from a lower edge of said edge portion in a closed position at varying distances from said edge portion less than the overall pitch height of the threaded connection between said first projection means and the container;

whereby, one of said second projections located closest to said edge portion in the closed position initiates lifting of said inner cap after unthreading of said outer cap and the container has started.

2. A screwcap according to claim 1 wherein said outer edge portion of said inner cap slopes outwardly.

3. A screwcap according to claim 2 wherein a first set of two of said second projections are diametrically opposed and are spaced from said edge portion by a distance greater than said one second projection, said one second projection being located between said second projections of said first set.

4. A screwcap according to claim 3 wherein said outer edge portion supports said seal means on an inner surface of said outer edge portion; and said outer cap has a corresponding sloping part engaging an outer surface of said outer edge portion; whereby sealing pressure is transferred in a radially inward direction from said outer cap.

5. A screwcap according to claim 3 wherein said inner cap comprises a downwardly open, peripheral groove having a trapezoidal cross-sectional configuration, at least part of said groove supporting said sealing means.

6. A screwcap according to claim 5 wherein said sealing means is on a radially inner wall of said groove on said inner cap for contacting an inner bead of a container opening edge; and a projection on said outer cap engages an outer surface of said radially inner wall applying a sealing pressure in a radially outward direction.

7. A screwcap according to claim 1 wherein a first set of two of said second projections are diametrically opposed and are spaced from said edge portion by a distance greater than said one second projection, said one second projection being located between said second projections of said first set.

8. A screwcap according to claim 1 wherein said inner cap comprises an annular step engaging a portion of said outer cap to center the inner cap relative to the outer cap.

9. A screwcap according to claim 8 wherein said outer cap has an upper terminating wall with a central, circular opening, said opening having an edge engaging said annular step.

10. A screwcap according to claim 9 wherein upper terminating surfaces of said inner and outer caps are located in a single plane and are separated by an annular gap; and a guarantee foil is attached to said terminating surfaces and bridges said gap.

11. A screwcap according to claim 1 wherein said one projection is positioned centrally above said first projection means; and said first projection means comprises a rib sloping in a peripheral direction for screw contact.

12. A container, comprising:

a neck portion including an opening with an opening edge, and a sloping projection for forming a threaded connection with an overall pitch height; and a screwcap including an inner cap formed of sheet metal, having seal means for forming a seal with said opening edge and having an outer edge portion, and a plastic outer cap having a collar, at least one radially inwardly directed first projection means, on an inner surface of said collar, for threadedly engaging said sloping projection forming said threaded connection, and a plurality of radially inwardly extending second projections peripherally distributed on said collar engaging said edge portion of said inner cap in an opening postion, said second projections being separate from said first projection means and being spaced from a lower edge of said edge portion in a closed position at varying distances from said edge portion less than said overall pitch height of said threaded connection between said first projection means and said sloping projection;

whereby, one of said second projections located closest to said edge portion in the closed position initiates lifting of said inner cap and seal means at a locally defined peripheral point on said inner cap after unthreading of said outer cap and said neck has started.

13. A container according to claim 12 wherein said outer edge portion of said inner cap slopes outwardly.

14. A container according to claim 13 wherein a first set of two of said second projections are diametrically opposed and are spaced from said edge portion by a distance greater than said one second projection, said one second projection being located between said second projections of said first set.

15. A container according to claim 14 wherein said outer portion supports said seal means on an inner surface of said outer edge portion; and said outer cap has a corresponding sloping part engaging an outer surface of said outer edge portion; whereby sealing pressure is transferrd in a radially inward direction from said outer cap.

16. A container according to claim 14 wherein said inner cap comprises a downwardly open, peripheral groove having a trapezoidal cross-sectional configuration, at least part of said groove supporting said sealing means.

17. A container according to claim 16 wherein said sealing means is on a radially inner wall of said groove on said inner cap for contacting an inner bead of said opening edge; and a projection on said outer cap engages an outer surface of said radially inner wall applying a sealing pressure in a radially outward direction.

18. A container according to claim 12 wherein a first set of two of said second projections are diametrically opposed and are spaced from said edge portion by a distance greater than said one second projection, said one second projection being located between said second projections of said first set.

19. A container according to claim 12 wherein said inner cap comprises an annular step engaging a portion of said outer cap to center the inner cap relative to the outer cap.

20. A container according to claim 19 wherein said outer cap has an upper terminating wall with a central, circular opening, said opening having an edge engaging said annular step.

21. A container according to claim 20 wherein upper terminating surfaces of said inner and outer caps are located in a single plane and are separated by an annular gap; and a guarantee foil is attached to said terminating surfaces and bridges said gap.

22. A container according to claim 12 wherein said one projection is positioned centrally above said first projection means; and said first projection means comprises a rib sloping in a peripheral direction for screw contact.

* * * * *